US005320453A

United States Patent [19]

Bullivant

[11] Patent Number: 5,320,453

[45] Date of Patent: Jun. 14, 1994

[54] COMPOSITE SECTIONAL CONCRETE PILES

[75] Inventor: Roger A. Bullivant, Burton-on-Trent, England

[73] Assignee: Roger Bullivant of Texas, Inc., Grand Prairie, Tex.

[21] Appl. No.: 864,317

[22] Filed: Apr. 6, 1992

[30] Foreign Application Priority Data

Apr. 11, 1991 [GB] United Kingdom ..... 9107672

[51] Int. Cl.[5] ..... E02D 5/30; E02D 5/10

[52] U.S. Cl. ..... 405/239; 405/249; 405/252; 405/256

[58] Field of Search ..... 405/239, 249, 251, 252, 405/256, 257, 232, 231

[56] References Cited

U.S. PATENT DOCUMENTS

| | | | |
|---|---|---|---|
| 3,762,173 | 10/1973 | Marsh | 405/249 |
| 4,127,002 | 11/1978 | DeWitt | 405/239 |
| 4,548,526 | 10/1985 | Bullivant . | |
| 4,605,339 | 8/1986 | Bullivant . | |
| 4,627,769 | 12/1986 | Lee | 405/256 |
| 4,659,256 | 4/1987 | Bullivant . | |
| 4,735,527 | 4/1988 | Bullivant . | |
| 4,797,037 | 1/1989 | Hong | 405/251 X |
| 4,824,292 | 4/1989 | Bullivant . | |
| 4,834,582 | 5/1989 | Bullivant . | |
| 4,836,717 | 6/1989 | Landaeus et al. | 405/251 X |
| 4,840,517 | 6/1989 | Bullivant . | |
| 4,915,544 | 4/1990 | Lin | 405/239 X |
| 5,096,333 | 3/1992 | Bassett | 405/252 X |

FOREIGN PATENT DOCUMENTS

| | | |
|---|---|---|
| 796262 | 6/1958 | United Kingdom . |
| 1079279 | 8/1967 | United Kingdom . |
| 1167499 | 10/1969 | United Kingdom . |
| 1209639 | 10/1970 | United Kingdom . |
| 2091313 | 7/1982 | United Kingdom . |
| 2126268 | 3/1984 | United Kingdom . |
| 2172038 | 1/1989 | United Kingdom . |

*Primary Examiner*—Randolph A. Reese
*Assistant Examiner*—J. Russell McBee
*Attorney, Agent, or Firm*—Richards, Medlock & Andrews

[57] ABSTRACT

A method of driving a sectional hollow concrete pile comprises applying a direct driving force to the upper end of a first pile section and driving it into the ground. Thereafter, a second similar pile section is applied to the top of the first driven pile section and the composite sectional pile is driven to the required depth. Further, similar sections may be applied one on top of the other and the composite pile thereby formed after the application of each further pile section is driven to the required depth.

23 Claims, 1 Drawing Sheet

COMPOSITE SECTIONAL CONCRETE PILES

TECHNICAL FIELD OF THE INVENTION

The present invention concerns improvements in or relating to hollow concrete piles.

BACKGROUND OF THE INVENTION

A conventional method of providing piles is to drive a one piece hollow steel casing into the ground to a sufficient depth and thereafter to pour concrete into the interior of the casing (with or without reinforcement) to provide a steel cased concrete pile.

Various methods have been employed in driving such piles including top drive with a hammering action either by the user or a larger mass or a relatively small mass vibrating at a high frequency, or bottom drive using similar techniques, or jacking by applying a downward force to the pile top from an hydraulic jack interposed between the pile top and a fixed reactive member, for example an existing building structure.

As a result of the cost of material employed, piles of the type described above are relatively expensive and attempts have been made in the past to utilize hollow concrete piles which are less expensive to manufacture.

One proposal has involved the use of sectional hollow concrete piles which are driven from above utilizing a pile section carrier or mandrel. Clearly, concrete piles cannot tolerate the same compressive impact loads as steel piles and so that they can be economically driven on past concrete pile driving operations, have involved threading the pile sections onto a central steel mandrel which carried at its forward end a sacrificial nose, the outside diameter of which is slightly greater than the outside diameter of the cylindrical concrete sections. With this arrangement the driving force from the pile driving hammer is transmitted to the nose by the central steel mandrel and the pile sections are simply carried down with the mandrel. When a sufficient depth of pile has been driven, the mandrel can be removed leaving the concrete sections and sacrificial nose in the ground. If desired, the hollow concrete pile can then be filled with reinforcement and concrete.

The method described above is disadvantageous in that if a pile of relatively long length is required, it is often necessary to interrupt the pile driving sequence and insert a longer mandrel after having threaded it through additional pile sections.

It is an object of the present invention to obviate or mitigate these disadvantages.

SUMMARY OF THE INVENTION

According to the present invention, there is provided a method of driving a sectional hollow concrete pile, comprising applying a direct driving force to the upper end of a first pile section and driving it into the ground, thereafter applying a second similar pile section to the top of the driven first pile section and driving the composite sectional pile to the required depth.

Preferably, a plurality of similar pile sections are successively applied to the first pile section one on top of the other.

Preferably the pile driving technique involves applying impact loading to the top of the pile either by impactors or oscillators.

Preferably the driving force is applied to the pile by way of a resilient load cushioning member.

The bottom of the pile may be closed off as it is driven.

Alternatively, when the pile is being driven, it remains open-ended whereby as the pile moves into the ground it displaces only the ground from the regions its material occupies and not from the interior of the pile.

Further, according to the present invention, there is provided a sectional concrete pile comprising a plurality of similar interfitting hollow sections, each having a cap at its upper and lower ends formed integrally therewith, the cap being formed from material which is more resistant to impact loading than concrete.

Preferably the pile caps are manufactured from steel.

Preferably the pile sections have an external diameter at one end which is slightly less than the external diameter at the other end.

Preferably interconnecting means are provided at each end of the pile sections.

The pile sections of the present invention are manufactured by casting in a mold. Preferably the concrete from which they are cast has reinforcing fibers mixed therewith. The reinforcing fibers may be steel or polypropylene.

The pile sections may be between one and a maximum of six meters long.

Preferably a baffle is provided in the composite pile, spaced from its upper end and concrete reinforcement, if necessary, in the pile above the baffle after the pile has been driven to the required depth.

Preferably an impact absorbing material is interposed between each pile section at its abutting ends.

The impact absorbing material may be a bituminous material. The bituminous material is preferably contained within the interstices of a reticular sheet.

BRIEF DESCRIPTION OF THE DRAWINGS

Embodiments of the present invention will now be described by way of example only with reference to the accompanying drawings in which.

DETAILED DESCRIPTION OF THE INVENTION

Figure 1:
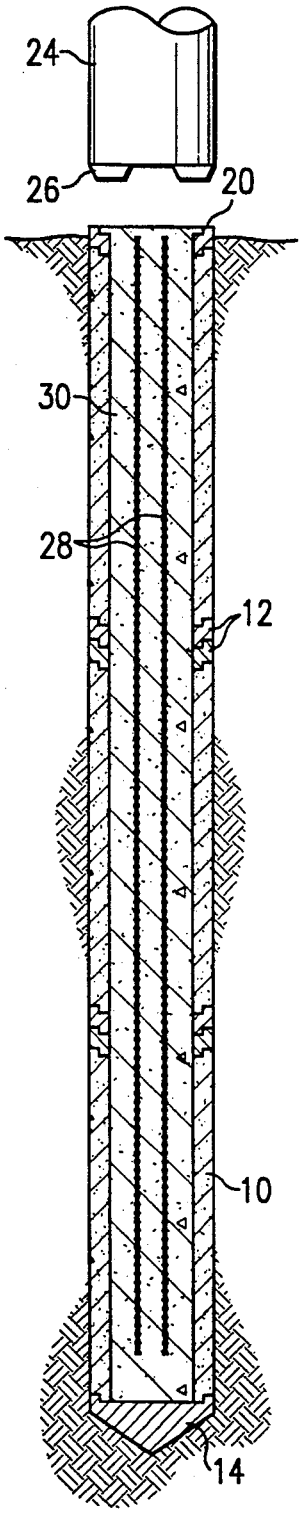
FIG. 1 shows a diagrammatic cross-sectional elevation through a driven section or pile.

A pile, as illustrated in FIG. 1, comprises a plurality of similar sections 10 arranged in end to end relationship, the sections being driven one by one into the ground by a carefully controlled impact or vibrating assembly 24 shown diagrammatically in FIG. 1, the assembly being controlled such that the load applied to the pile sections 10 do not damage them but drive them relatively rapidly into the ground. A resilient cushioning member 26 is provided on the pile driving means to lessen the direct impact on the pile top of the driving force. The cushioning member serves to release the driving energy to the pile over a longer period. The period is of very small duration but has a beneficial effect.

Figure 4:
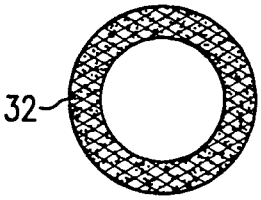
FIG. 4 shows a cushioning member.

Each section 10 comprises a hollow concrete cylinder which may or may not have reinforcement formed integrally therewith. The reinforcement, if used, is preferably steel fibers, although polypropylene or other reinforcing fibers may be used. The pile section is manufactured by casting and to assist in removal of a cast pile from the mold it tapers by a small angle from one end to the other. Integrally cast into each end there is provided a metal cap or collar 12, which is provided with any suitable interconnection means so that the collar of one end can locate with and be guided by the collar of the other end of a neighboring pile during driving so that the load from the upper section is evenly distributed on the lower section during the driving operation. Shock absorbing pads of, for example, a hard plastic material or hard board may be incorporated in the pile collars. Alternatively, the shock absorbing means at the pile joints may be provided by a material which is fluent during the driving operation but sets hard after driving. The material could be wet unset cementitious mix, or a bitumen/sand mix or an epoxy resin held in an expanded metal sheet of the type disclosed in Applicant's U.K. Patent 2172038. FIG. 4 illustrates a shock absorbing disc 32 of an expanded metal mesh. The interstices of the mesh are filled with a bitumen/sand mixture.

At the forward end of the lowermost pile section there is provided a metal end cap 14 which conveniently has a conical or flat shape, the base diameter of which may be greater than the maximum external diameter of the section so that it effectively forms a hole of marginal over-size thereby reducing skin friction between the external surface of the pile and the ground through which it is being driven.

When the pile is driven to a predetermined depth, additional reinforcement 28 may be incorporated into its interior and the interior filled with concrete 30 from above. The pile can then have a structure built thereon or it can be bonded to an existing structure it is intended to support.

Figure 2:
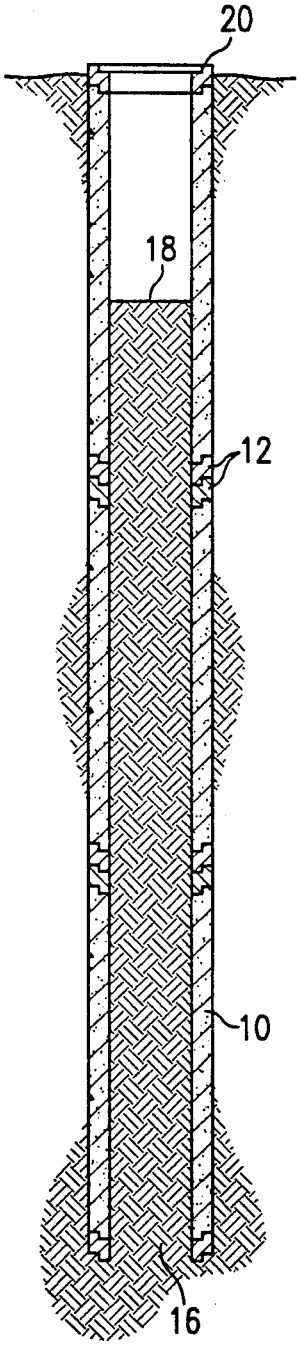
FIGS. 2 and 3 show modifications of the pile shown in FIG. 1.

The first modification of the invention is shown in FIG. 2 where a sectional pile, similar to that shown in FIG. 1, is driven but without the provisions of a leading end cap 14.

In the past, one piece steel piles have been driven by the application of a hammer in a normal pile driving technique. The steel piles have often had an H cross-section and, in view of their relatively small cross-section, have given little end bearing effect. They have, however, had the advantage that they could be driven with relatively little disruption to the surrounding structure in view of the small cross-section they present to the ground. Such piles have to rely on the skin friction between the pile and the surrounding ground for their load bearing effect. They have had the considerable disadvantage of having to be driven in one piece. Providing a section pile of this nature by welding sections together or employing conventional bolting techniques has been time consuming and inefficient in that a fully aligned pile cannot always be guaranteed. Use of this pile has been confined to those situations where the headroom is unrestricted, so that they are generally unsuitable for use in supporting existing structures. In addition, they have to be relatively long to present sufficient surface area to the earth to give the required load bearing characteristics.

FIG. 2 shows a modified pile according to the present invention which comprises a plurality of sections 10, each having a metal cap 12 at each end to provide interconnection between the neighboring sections. The lowermost section 10, in common with the other sections, has an open end 16 and this, coupled with the direct pile driving techniques on the hollow concrete pile, is a departure from certain existing tubular piles which have a closed end. On driving piles according to the embodiment shown in FIG. 2, the sub-soil penetrates into the pile and as a result of skin friction between the soil within the pile and the internal walls of the pile, the soil is compressed so that its free surface 18, when the pile is fully driven, lies below the top 20 of the pile. The pile has an end load bearing capacity which is determined not only by the cross-sectional area of its lowermost end but also by the skin friction between the external and internal surfaces of the pile and the surrounding ground so that, in effect, the driven pile has an end load bearing capacity equal to a solid or closed ended pile of the same dimensions. The pile relies for its rigidity against bending in normal circumstances on its own construction as opposed to existing metal tubular piles where such rigidity is achieved by pouring concrete into the interior of the pile which, of course, does not contain any earth as the leading end of the pile is closed during and after the driving operation.

As the soil within the pile is effectively isolated from its surroundings and the mass of the pile is small, and if the pile is driven into the ground which is subjected to displacement heave, movement of the external surrounding soil relative to the outer surface of the pile will have no appreciable effect.

Figure 3:
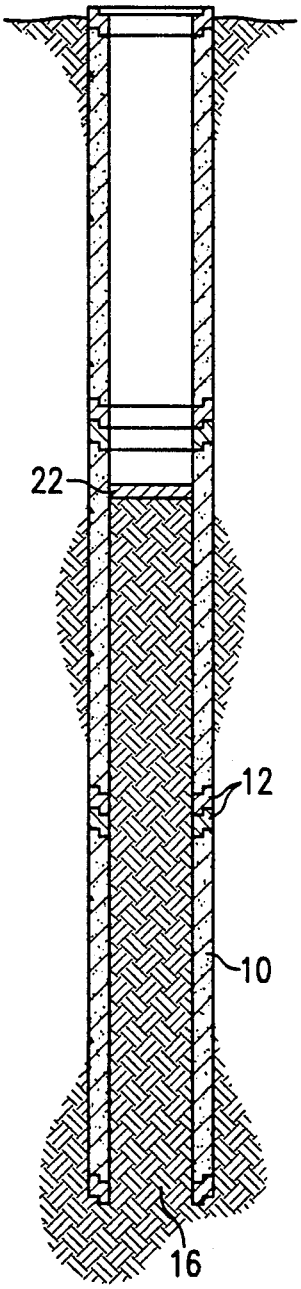

In the modification shown in FIG. 3 there is shown a sectional pile which, in addition to vertical loads, has to resist bending stresses. It has been discovered that the bending stresses are concentrated at the top of the pile, normally over the top three meters, and to give it greater rigidity over this length, a baffle 22 is fixed across the pile at a depth which will approximate to the desired three meters when the pile is finally driven. After the driving operation has been completed, concrete and, if necessary reinforcement, is introduced into the upper open end of the pile above the baffle 22.

Various modifications can be made without departing from the scope of the invention. For example, the interconnection between the pile sections can take any convenient form. Additionally, the pile cross-section need not be cylindrical but could be square, hexagonal or triangular or any other convenient shape.

I claim:

1. A method of driving into sub-soil a composite sectional hollow concrete pile having an upper end and a lower end, said composite sectional hollow concrete pile being comprised of a plurality of hollow concrete pile sections, each with an upper end and a bottom end and a hollow interior, said method comprising the steps of:

applying a direct driving force to the upper end of a first one of said hollow concrete pile sections and driving the first one of said hollow concrete pile sections into the ground;

thereafter applying the bottom end of a second one of said hollow concrete pile sections to the upper end of the thus driven first one of said hollow concrete pile sections to form a composite sectional hollow concrete pile, and applying a direct driving force to the upper end of the composite sectional hollow concrete pile to drive the composite sectional hollow concrete pile to the desired depth, wherein, as the composite sectional hollow concrete pile is driven, the bottom end of the first one of said hollow concrete pile sections is open so that the sub-soil penetrates into the hollow interior of the first one of said hollow concrete pile sections.

2. A method according to claim 1 further comprising applying the bottom end of an additional one of said hollow concrete pile sections to the upper end of the second one of said hollow concrete pile sections and applying a direct driving force to the upper end of said additional one of said hollow concrete pile sections to drive the resulting newly formed composite sectional hollow concrete pile to the desired depth.

3. A method according to claim 1 wherein the step of applying a direct driving force to the upper end of the composite sectional hollow concrete pile comprises applying impact loading to the upper end of the composite sectional hollow concrete pile by impactors to drive the composite sectional hollow concrete pile to the desired depth.

4. A method according to claim 1 wherein the step of applying a direct driving force to the upper end of the composite sectional hollow concrete pile comprises applying the direct driving force by engaging the upper end of the composite sectional hollow concrete pile through a resilient load-cushioning member.

5. A method according to claim 1 further comprising reinforcing an upper portion of the composite sectional hollow concrete pile after the composite sectional hollow concrete pile has been driven to the desired depth.

6. A method according to claim 1 further comprising placing a baffle in the hollow interior of one of said hollow concrete pile sections at a distance from the upper end thereof, and after driving the composite sectional hollow concrete pile, reinforcing the composite sectional hollow concrete pile above the baffle.

7. A method according to claim 6 wherein the step of reinforcing the composite sectional hollow concrete pile comprises pouring concrete into the hollow interior of a hollow concrete pile section at a point above the baffle to add concrete thereto above the baffle.

8. A method according to claim 1, wherein each of said hollow concrete pile sections has an open upper end and an open bottom end.

9. A method according to claim 8, wherein the open upper end of each of said hollow concrete pile sections is provided with a collar formed of a material which is more resistant to impact loading than concrete, wherein the step of applying a direct driving force to the upper end of the first one of said hollow concrete pile sections comprises applying a direct driving force to the collar on the upper end of the first one of said hollow concrete pile sections so as to not damage the first one of said hollow concrete pile sections, and wherein the step of applying a direct driving force to the upper end of the composite sectional hollow concrete pile comprises applying a direct driving force to the collar on the upper end of the composite sectional hollow concrete pile so as to not damage the composite sectional hollow concrete pile.

10. A method according to claim 9, wherein the open bottom end of each of said hollow concrete pile sections is provided with a collar formed of a material which is more resistant to impact loading than concrete, with the collar on the bottom end of each of said hollow concrete pile sections other than the first one of said hollow concrete pile sections being interconnected with the collar on the upper end of a neighboring hollow concrete pile section to thereby form a pair of interconnected collars so that the force applied to a respective hollow concrete pile section other than the first one of said hollow concrete pile sections by the driving force applied to the collar on the upper end of the composite sectional hollow concrete pile is evenly distributed on the upper end of a next lower one of said hollow concrete pile sections in the composite sectional hollow concrete pile.

11. A method according to claim 10, further comprising placing a shock absorbing material between the collars of each pair of interconnected collars.

12. A composite sectional concrete pile having an upper end and a lower end and comprising a plurality of similar end to end interfitted hollow concrete pile sections, each hollow concrete pile section having an open upper end and an open lower end and a hollow interior, each hollow concrete pile section having an upper collar at its open upper end and a lower collar at its open lower end, each collar being formed from an impact resistant material which is more resistant to impact loading than concrete, with the lower collar on the lower end of each of said hollow concrete pile sections other than a lowermost one of said hollow concrete pile sections being interfitted with the collar on the upper end of a neighboring hollow concrete pile section without welding the pile sections together to thereby form at least one pair of interfitted collars, the collars of each pair of interfitted collars being interfitted so that one of the collars of a pair of interfitted collars can locate with and be guided by a collar with which it is interfitted, the collars of each pair of interfitted collars having a shock absorbing material positioned therebetween so that a driving force applied to the upper collar on an uppermost one of said hollow concrete pile sections is evenly distributed on the upper end of each of said hollow concrete pile sections in the composite sectional hollow concrete pile below the uppermost one of said hollow concrete pile sections.

13. A composite sectional concrete pile according to claim 12, wherein the upper and lower collars of each hollow concrete pile section are formed integrally therewith.

14. A composite sectional concrete pile according to claim 12, wherein said shock absorbing material comprises a bitumen and sand combination.

15. A composite sectional concrete pile according to claim 12, wherein said shock absorbing material comprises an epoxy resin.

16. A composite sectional concrete pile according to claim 12, wherein the shock absorbing material is contained within the interstices of a reticular sheet.

17. A composite sectional concrete pile according to claim 12, wherein said shock absorbing material comprises an expanded metal mesh and a bitumen and sand combination.

18. A composite sectional concrete pile according to claim 12, wherein said shock absorbing material comprises an expanded metal mesh and an epoxy resin.

19. A composite sectional concrete pile according to claim 12, wherein said shock absorbing material comprises a wet unset cementitious material.

20. A composite sectional concrete pile according to claim 12, wherein each of the collars is manufactured from steel.

21. A composite sectional concrete pile according to claim 12, wherein each of the hollow concrete pile sections is cast from concrete containing reinforcing elements.

22. A composite sectional concrete pile having an upper end and a lower end and comprising a plurality of similar end to end interconnected hollow concrete pile sections, each hollow concrete pile section having an open upper end and an open lower end and a hollow interior, each hollow concrete pile section having an upper collar at its open upper end and a lower collar at its open lower end, each collar being formed from an impact resistant material which is more resistant to impact loading than concrete, with the lower collar on the lower end of each of said hollow concrete pile sections other than a lowermost one of said hollow concrete pile sections being interconnected with the collar on the upper end of a neighboring hollow concrete pile section to thereby form at least one pair of interconnected collars, the collars of each pair of interconnected collars being interconnected so that one of the collars of a pair of interconnected collars can locate with and be guided by a collar with which it is interconnected, the collars of each pair of interconnected collars having a shock absorbing material positioned therebetween so that a driving force applied to the upper collar on an uppermost one of said hollow concrete pile sections is evenly distributed on the upper end of each of said hollow concrete pile sections in the composite sectional hollow concrete pile below the uppermost one of said hollow concrete pile sections, a baffle positioned in a hollow interior of one of said hollow concrete pile sections and spaced from the upper end of the composite sectional concrete pile, with concrete in the hollow interior above the baffle.

23. A composite sectional concrete pile according to claim 22, further comprising reinforcement in the concrete in the hollow interior above the baffle.

* * * * *